United States Patent [19]

Meehan et al.

[11] Patent Number: 4,882,910

[45] Date of Patent: Nov. 28, 1989

[54] REFRIGERATION SYSTEM FOR PRODUCT DISPLAY ENCLOSURES

[76] Inventors: Kermit E. Meehan; William T. Nichols, both of Wayzata; Timothy S. Meehan; Robert A. Essig, both of Minneapolis, all of Minn.

[21] Appl. No.: 308,142

[22] Filed: Feb. 8, 1989

[51] Int. Cl.[4] ..... A47F 3/04

[52] U.S. Cl. ..... 62/256; 62/237; 62/448

[58] Field of Search ..... 62/298, 448, 237, 457.1, 62/256, 255

[56] References Cited

U.S. PATENT DOCUMENTS

| | | | |
|---|---|---|---|
| 2,915,884 | 12/1959 | Haushalter et al. | 62/256 |
| 2,929,229 | 3/1960 | Detwiler | 62/256 X |
| 3,230,733 | 1/1966 | Rutishauser et al. | 62/448 X |
| 3,324,783 | 6/1967 | Hickox | 62/256 X |
| 4,120,174 | 10/1978 | Johnston | 62/256 |

*Primary Examiner*—Lloyd L. King
*Attorney, Agent, or Firm*—Haugen and Nikolai

[57] ABSTRACT

A refrigeration and display assembly includes a display container with an open top, a refrigeration enclosure beneath and supporting the container, and an outer housing surrounding the enclosure and display container. A pair of openings formed in the display container floor are positioned for respective alignment with inlet and outlet openings of the refrigeration enclosure, when the container and enclosure are engaged. The floor and side walls of the container are constructed of pairs of panels fastened together. Grooves are formed in one of the panels of each pair, whereupon the joinder of the panels forms fluid channels for circulation of air between the container and enclosure. The housing surrounds and hides the refrigeration enclosure from view, while maintaining the display enclosure in a snug, nesting fashion.

18 Claims, 3 Drawing Sheets

REFRIGERATION SYSTEM FOR PRODUCT DISPLAY ENCLOSURES

BACKGROUND OF THE INVENTION

This invention relates to equipment for housing and displaying articles requiring refrigeration, and more particularly to portable equipment for storing and displaying such articles.

The refrigeration of food and other products is well known, particularly with reference to employing a refrigerant in a vapor compression cycle, and moving air past an evaporator in the vapor compression cycle to cool the air before supplying it to the refrigeration enclosure. The common household refrigerator operates in this manner. Certain applications outside of the household place unique demands upon refrigeration equipment. For example, at trade shows, fairs and the like, space typically is available only at a premium, and display or vending is temporary. Consequently, it is desirable for refrigeration equipment to be small and compact, portable and easily assembled and disassembled. Furthermore, displays or vending situations may involve a wide variety of products, though all types of products are not available or displayed simultaneously. In such situations, it is desirable to provide a display compartment designed to most effectively display a particular product. However, if each display unit for a particular product must contain equipment forming the vapor compression refrigeration cycle, a multiplicity of product display units become prohibitively expensive.

Therefore, it is an object of the present invention to provide a refrigeration system in which a variety of display enclosures can be interchangeably connected to a refrigeration enclosure.

Another object of the invention is to provide a refrigeration system in which separate display and refrigeration units are easily assembled into one device, and later easily disassembled for ease in transporting the system.

Yet another object is to provide a refrigeration system in which structure forming air supply and air return conduits to a display enclosure is positioned in operative relation to the vapor compression refrigerant cycle components upon the connection of the display unit to a refrigeration enclosure.

SUMMARY OF THE INVENTION

To achieve these and other objects, there is provided a portable refrigeration apparatus. The apparatus includes a refrigeration enclosure having an upper deck, a lower deck, and an upright enclosure side wall means joined to the upper and lower decks. An inlet opening is formed in the upper deck for admitting fluid into the enclosure, and an outlet opening is formed in the upper deck for discharging fluid out of the enclosure. A cooling means within the enclosure is provided for cooling the fluid. The apparatus further includes a display container having a container floor and an upright container side wall means joined to the floor. First and second openings are formed in the floor, spaced apart from one another, and are open to the exterior of the container. A first fluid passageway is formed in the container side wall means in fluid communication with the first opening and with the interior of the container. A second fluid passageway is formed in the container side wall means, in fluid communication with the second opening and with the interior of the container. A connecting means removably connects the container and the enclosure with the floor contiguous with the enclosure upper deck, and with the first and second openings in fluid communication with the inlet and outlet openings, respectively.

Preferably the first and second openings, and inlet and outlet openings, are substantially the same size and positioned to allow an alternative connection of the enclosure and container wherein the first opening and outlet are in fluid communication, as are the second opening and inlet.

In one preferred version of the apparatus, the container side wall means is rectangular and includes four substantially planar container side walls. Each side wall includes a pair of associated panels fixed to one another along their contiguous surfaces, including an outside upright panel and an inside upright panel. First and second upright grooves are formed in one of the panels of each pair, so that with the panels fixed to one another, one of the contiguous surfaces cooperates with the first and second grooves to form respective first and second upright conduits. In somewhat similar fashion, the container floor can be formed of upper and lower panels, fixed to one another along their contiguous surfaces. First, second, third and fourth horizontal grooves are formed in one of the upper and lower panels, with the contiguous surface of the other panel cooperating with these grooves to form first, second, third and fourth fluid channels in the floor.

The first and second fluid channels combine with the first upright conduits to form the first passageway, while the third and fourth fluid channels combine with the second upright conduits to form the second fluid passageway. The third and fourth fluid channels are in fluid isolation from the first and second fluid channels. Consequently, the first passageway provides fluid to the refrigeration enclosure through the inlet, while the second passageway receives cooled fluid discharged from the refrigeration enclosure.

First and second flange means, extended upwardly from the upper deck, are disposed for respective nesting engagement within the first and second openings of the display container, resulting in a simple but stable removable connection between the container and refrigeration enclosure. The apparatus can also include a housing with a base and a housing side wall means extended upwardly from the base. The base supports the refrigeration enclosure, and the housing side wall means surrounds and is substantially contiguous with the container side wall means, to lend further stability to the container/enclosure connection.

As the connection of the enclosure and container depends merely upon the alignment of their respective openings, a variety of display containers can be configured for connection to the same refrigeration enclosure. Likewise, housings can be provided in a variety of shapes with housing side walls corresponding to the display container side walls. Thus, the refrigeration apparatus is easily disassembled for convenient transport, then easily reassembled at a new location. Assembly is a simple matter of properly positioning the refrigeration enclosure upon the housing base, where it is maintained by gravity, then loading the display container into the open housing and onto the enclosure. In the same manner a variety of display units, each custom-made for a different product, can be employed with a single refrigeration enclosure. This eliminates the need for a separate refrigeration unit for each display enclosure and housing, substantially reducing overall cost.

IN THE DRAWINGS

The above and other features and advantages are more readily appreciated upon consideration of the following detailed description in view of the drawings in which.

DETAILED DESCRIPTION OF THE PREFERRED EMBODIMENTS

Figure 1:
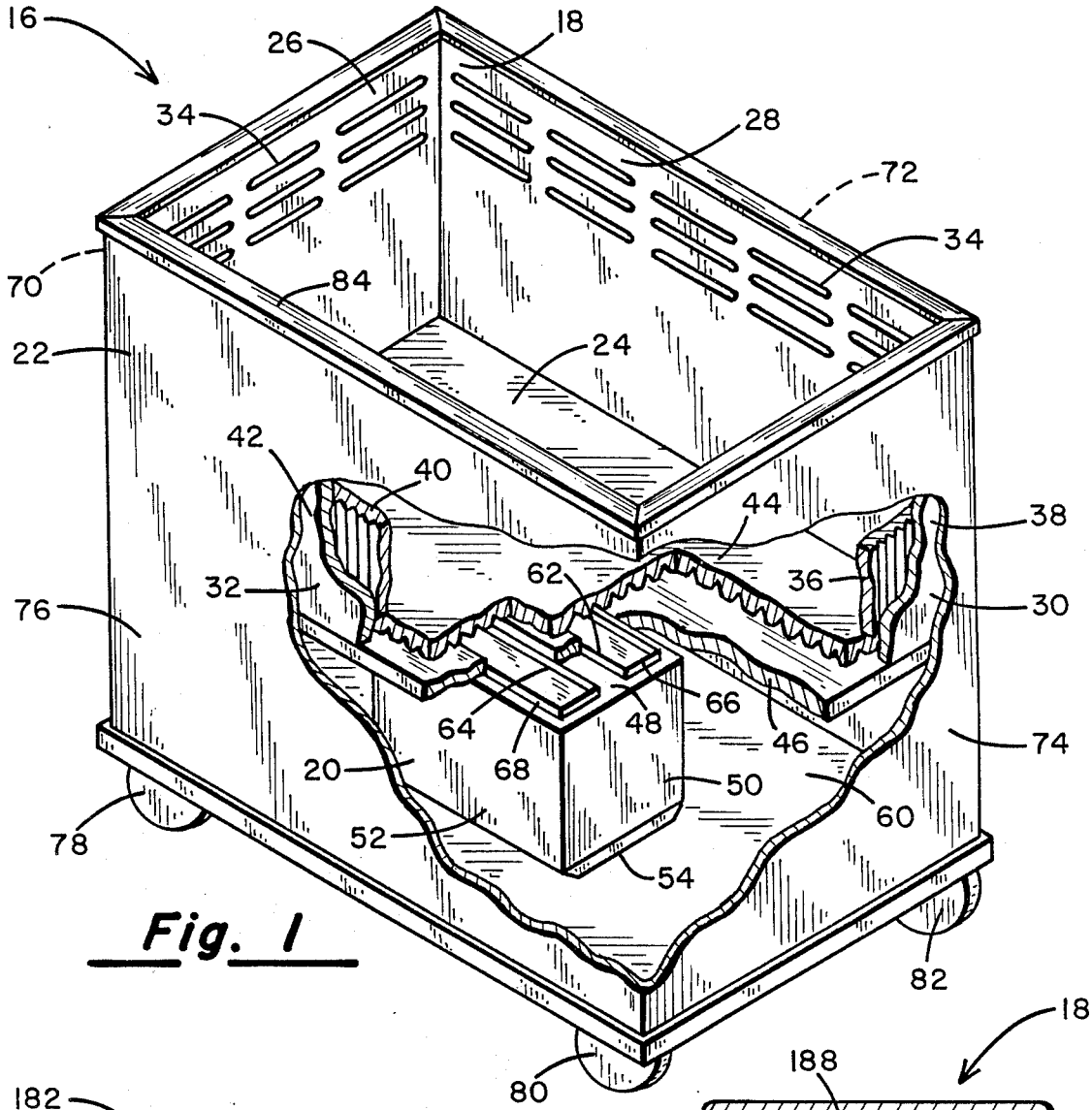
FIG. 1 is a perspective view showing a product display assembly including a display container, refrigeration enclosure and supporting housing constructed in accordance with the present invention.

Turning now to the drawings, there is shown in FIG. 1 a product refrigeration and display assembly 16 including three major parts, removably connected to one another: a display container 18, a refrigeration enclosure 20, and a housing 22 surrounding the display container and refrigeration enclosure. Display container 18 is rectangular with an open top, including a floor 24 and four upright container side walls 26, 28, 30 and 32. A plurality of slots 34 are formed near the top of each of the container side walls.

Each of container side walls 26–32 consists of two panels fastened together, side-by-side, for example an inside panel 36 and an outside panel 38 in the case of side wall 30, and an inside panel 40 and an outside panel 42 in the case of side wall 32. Likewise, floor 24 includes an upper panel 44 and a lower horizontal panel 46 fastened together. The panels are constructed of a rigid, thermally insulative material, e.g. an expanded foam product such as styrofoam. In each case, contiguous surfaces of the panels forming the walls and floor are coated with an adhesive to secure associated panels against one another.

Figure 9:
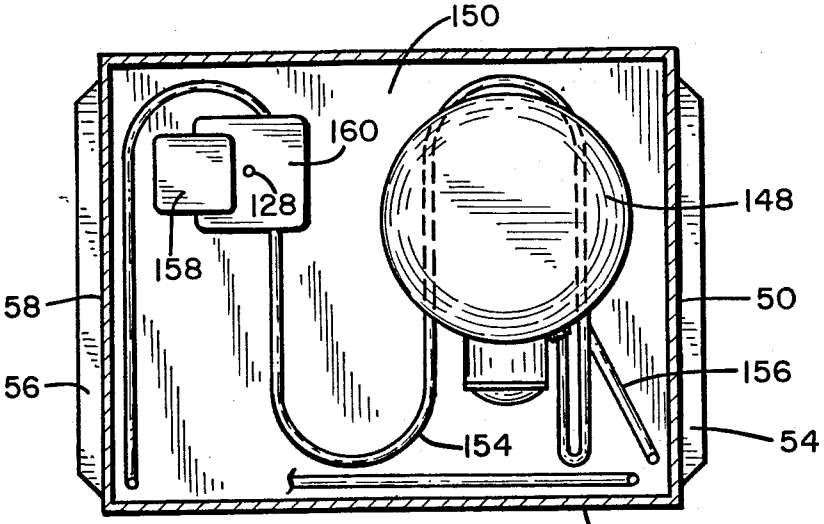
FIG. 9 is a sectional view taken along the line 9—9 in FIG. 7.
Figure 8:
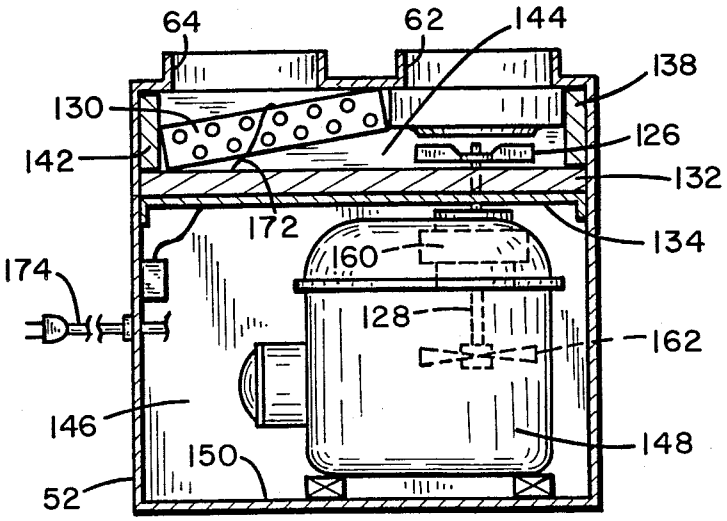
FIG. 8 is a sectional view taken along the line 8—8 in FIG. 7.
Figure 6:
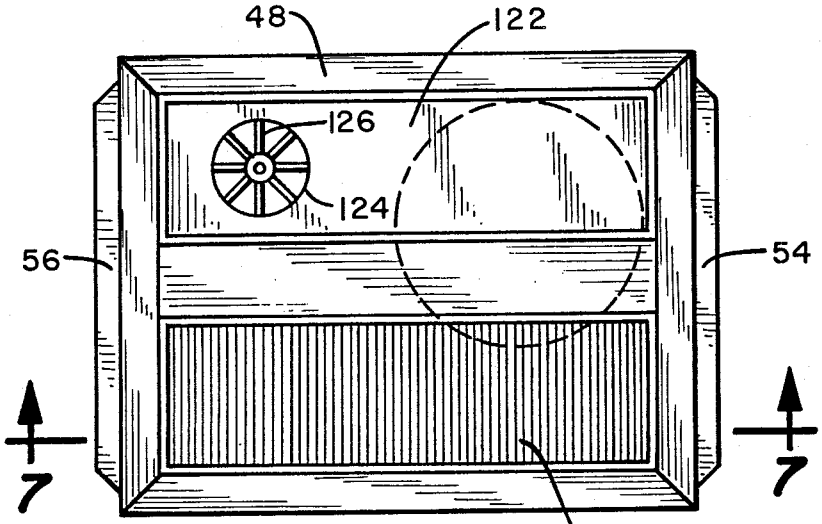
FIG. 6 is a top plan view of the refrigeration enclosure, removed from the rest of the assembly.
Figure 7:
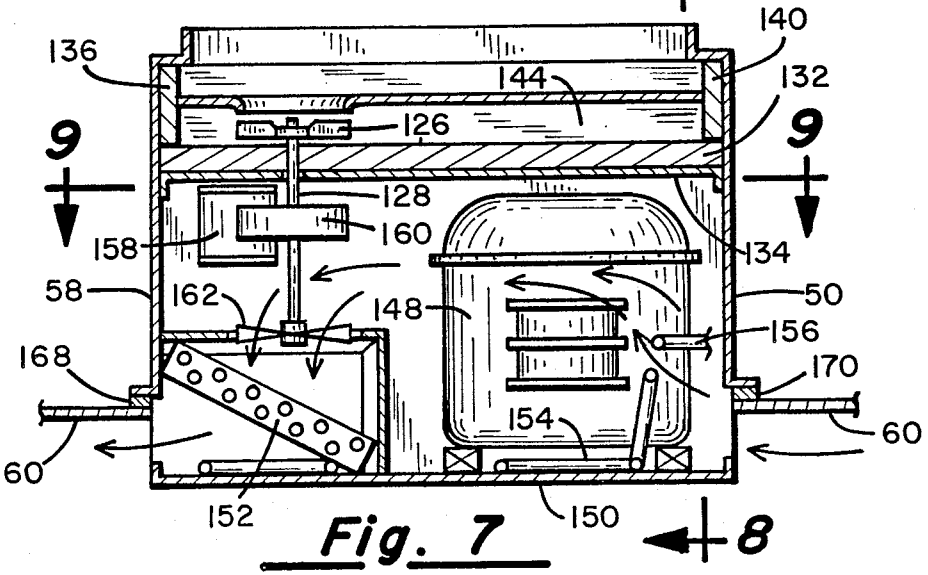
FIG. 7 is a sectional view taken along the line 7—7 in FIG. 6.

Refrigeration enclosure 20 supports display enclosure 16 by gravity, with the bottom of lower panel 46 contiguous with a horizontal upper deck 48 of enclosure 20. Four enclosure upright side walls, including two shown at 50 and 52, are joined to the upper deck and to a lower deck of the enclosure (FIGS. 7–9). Two opposed flanges 54 and 56 (FIG. 6) extend horizontally of enclosure side walls 50 and 58, respectively, whereby the enclosure is supported by gravity on a horizontal base 60 of housing 22. A bottom portion of the enclosure extends downwardly through an opening in the base (FIG. 7).

A pair of rectangular openings, namely an inlet opening 62 and an outlet opening 64, are formed through upper deck 48. Inlet opening 62 is surrounded by an upright rim or flange 66, and a similar flange or rim 68 surrounds the outlet opening. Air or another fluid to be refrigerated is received into the refrigeration enclosure through the inlet, and discharged from the outlet after it is cooled.

Housing 22 includes base 60 and four upright housing side walls 70, 72, 74 and 76 joined to the base. Four casters, three of which are shown at 78, 80 and 82, are mounted directly beneath base 60 to facilitate moving the assembly. Housing side walls 70–76 preferably are constructed of a strong, substantially rigid plastic. As is apparent from FIG. 2, side walls 26–32 of the container form a snug, nesting engagement with side walls 70–76 when the container is mounted within the housing. A top trim cover 84, covering the top edges of side walls 26–32 and 70–76, completes the assembly.

Figure 2:
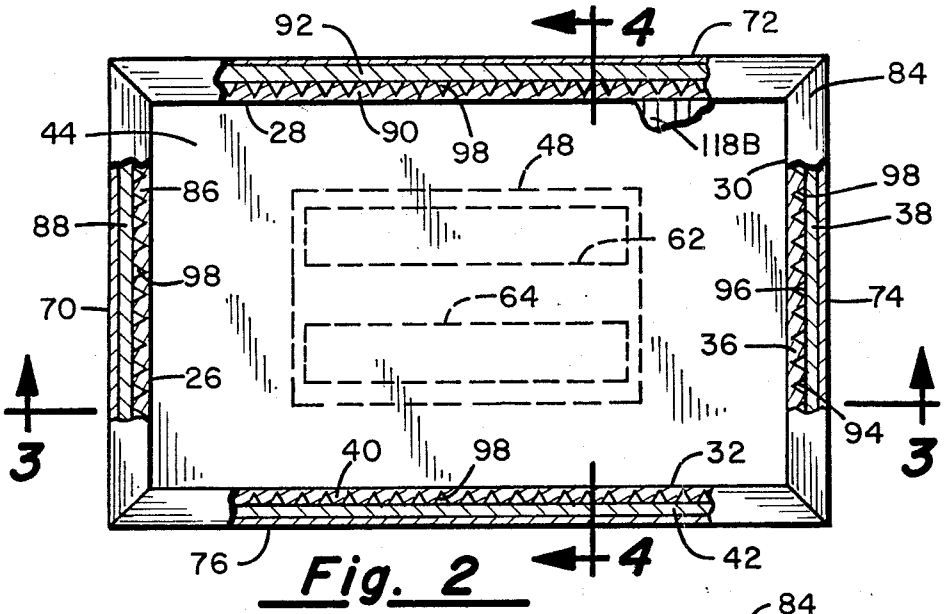
FIG. 2 is a top view of the assembly of FIG. 1, with portions removed to better illustrate certain parts.

As seen from FIG. 2, side wall 26 includes an inside panel 86 connected to an outside panel 88, and side wall 28 includes inside and outside panels at 90 and 92. Thus, each of the container side walls consists of an inside panel and an outside panel. Each of the inside panels has a series of upright, elongate triangular or V-shaped grooves 94, each groove running the entire height of its associated inside panel. Each groove need not be open to the top of its associated panel but should be open to the bottom and run at least to slots 34. Each of the outside panels has a flat inside surface, as indicated at 96 in connection with panel 38. Joinder of panels 36 and 38 thus forms a series of triangular upright conduits or channels 98, each channel being defined by one of the V-shaped grooves and part of flat inside surface 96 interfacing with the groove. Channels 98 are likewise formed in the other side walls. Triangular channels are easily formed and preserve the structural integrity of the inside panels. However, the channels can have another profile, e.g. semicircular, if desired.

Figure 4:
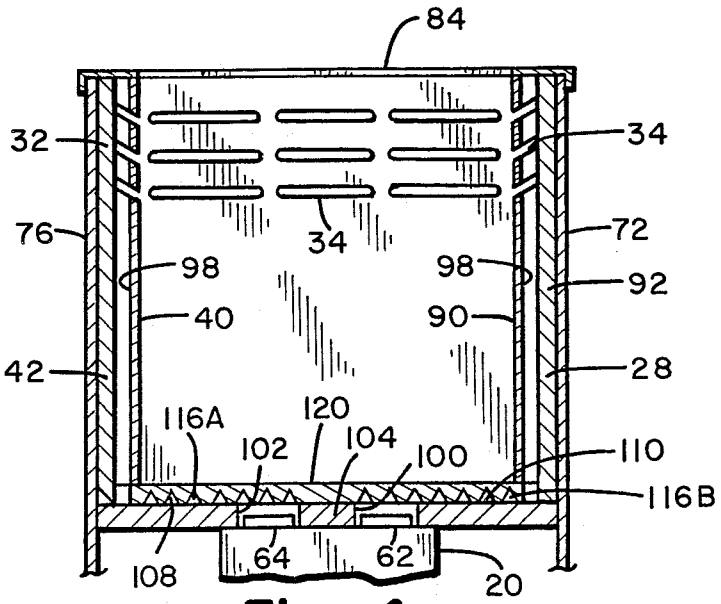
FIG. 4 is a sectional elevation taken along the line 4—4 in FIG. 2.
Figure 3:
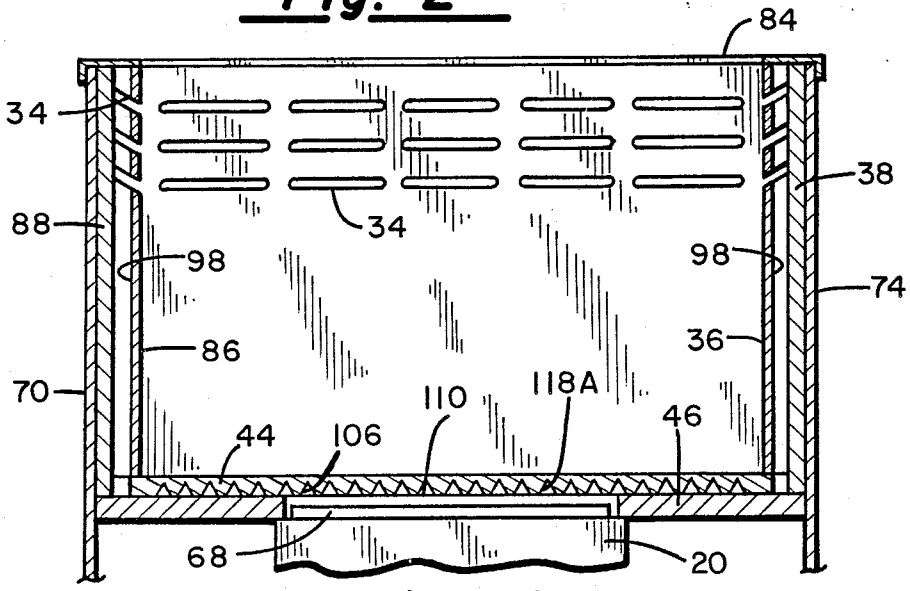
FIG. 3 is a sectional elevation taken along the line 3—3 in FIG. 2.

FIGS. 3 and 4 illustrate the manner in which display container 18 is supportd by gravity on upper deck 48 of refrigeration enclosure 20. Lower panel 46, like the outside panels, is essentially flat, and a portion of its bottom surface is contiguous with the upper deck. Further, two rectangular openings at 100 and 102 are formed through the lower panel to accommodate rims 66 and 68, whereby upper panel 44 is exposed to inlet and outlet openings 62 and 64. A central portion 104 of the lower panel, between openings 100 and 102, ensures that these openings, as well as the inlet and outlet, are in fluid isolation from one another.

Figure 5:
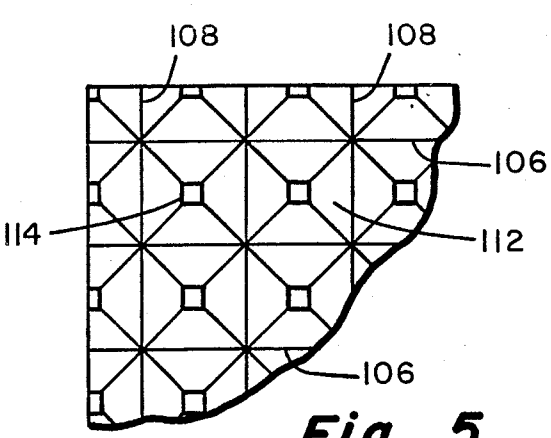
FIG. 5 is a sectional view taken along the line 5—5 in FIG. 4.

To provide for fluid communication between inlet 62, outlet 64 and vertical channels 98, two mutually perpendicular rows of grooves 106 and 108 are formed in the upper panel to interface with the top surface 110 of lower panel 46 and provide fluid channels or conduits. FIG. 5 shows a portion of the upper panel bottom surface, to reveal V-shaped grooves 106 and perpendicular V-shaped grooves 108. The combined result of grooves 106 and 108 is formation of a series of substantially identical inverted pyramids 112, with end surfaces 114 which together comprise the surface portion of upper panel 44 contiguous with lower panel 46. With panels 44 and 46 joined, grooves 106 and 108 interface with top surface 110 of the lower panel to form mutually perpendicular conduits or channels 116A, 116B, 118A and 118B. Conduits 116A permit passage of air from outlet 64 to upright conduits 98 in side walls 26 and 30. Conduits 116B permit air passage from the upright conduits in walls 26 and 30 to inlet 62. Conduits 118A permit air to flow from outlet 64 to the upright conduits in wall 32, and conduits 118B permit passage of air from the conduits in wall 28 to inlet 62. A central strip 120 of upper panel 44 is flat and without grooves, to isolate conduits 118A from conduits 118B. This ensures that the paths for inlet air and outlet air are mutually exclusive.

One feature of the present invention is the symmetrical location and equal sizing of inlet 62 and outlet 64, and corresponding openings 100 and 102 through lower panel 46. This enables a reverse construction of display assembly 16 in which opening 102 surrounds and is aligned with inlet 62, while opening 100 similarly engages outlet 64, with no affect on the flow of the refrigerated air. In either case, approximately half of the perimeter defined by side walls 26–32 provides conduits 98 for passage of air into display container 18, with the other half of the side wall perimeter providing a path for air to return to the refrigeration enclosure from the display container.

In FIGS. 3 and 4 it is apparent that slots 34 are inclined downwardly, inwardly of the display container. Consequently the slots, when supplying refrigerated air to the interior of container 18, direct the air downwardly into the container. This reduces the chance for cooled air to leave container 18 by its open top, enhancing the cooling efficiency of the display assembly. A further advantage is that return air is drawn at an upward angle, to minimize aspiration of warm air from above the display container.

FIGS. 6–9 disclose refrigeration enclosure 20 in greater detail. Inlet opening 62 has a relatively flat bottom 122 with a circular opening 124. An evaporator air impeller 126 rotates on a shaft 128 to draw air into the refrigeration enclosure for cooling. An evaporator coil 13 is positioned directly beneath outlet opening 64. An insulative floor 132 is supported on a shelf 134 mounted along its edges to the enclosure side walls. Insulative side walls are provided along enclosure side walls 136, 138, 140 and 142, to thermally isolate an upper chamber 144 of the refrigeration enclosure from a lower chamber 146.

As perhaps best seen in FIG. 8, the refrigeration of air occurs in upper chamber 144. Impeller 126 draws air into chamber 144 through inlet 62, and expels the air toward evaporator coil 130, where the air is cooled and discharged upwardly and out of enclosure 20 through outlet opening 64.

Remaining components of the refrigeration cycle are in lower chamber 146. A compressor 148, supported above a lower deck 150, supplies refrigerant to a condenser coil 152 through a compressor discharge line 154. Discharge line 154 is formed in a plurality of loops or reverses across the lower deck. Refrigerant in the loops heats lower deck 150 to promote evaporation of any condensate dripping from the base of evaporator coil 130. Refrigerant from condenser coil 152 proceeds along further refrigerant line to evaporator coil 130. Refrigerant from evaporator coil 130 is drawn along a compressor feed line 156 back to the compressor. It should be noted that the components of the refrigeration system are shown somewhat schematically, and the full length of all refrigerant lines are not illustrated, as the details of these components and their use along with refrigeration line, are known to those skilled in the art.

Shaft 128 is rotated by an electric motor 158 mounted to shelf 134, with a drive train 160 drivingly associating the shaft and motor. A condenser air fan 162 is mounted to the bottom of shaft 128 and rotates with the shaft, to draw air through lower chamber 146 for cooling the compressor and condenser. As mentioned above, refrigeration enclosure 20 is supported on base 60 of housing 22 by flanges 54 and 56, so that an inlet passage 164 and an outlet passage 166, for air respectively drawn into and discharged from the lower chamber, are below and outside of the housing. Because of this arrangement, ambient air is drawn for cooling the condenser and compressor. The heated air is discharged to the surrounding environment rather than into the housing below the display container. Resilient pads 168 and 170 are positioned between their associated flanges and base 60 in order to dampen vibration.

A temperature sensing control 172 is provided along the surface of evaporator 130, and terminates compressor operation whenever return air entering inlet 62 is sufficiently cool to reduce the evaporator coil temperature to a preselected cut-off level. Also, this control deactivates the compressor when frost on evaporator coil 130, between the fins, permits the evaporator temperature to drop to the selected level. When such circulating return air rises to a cut-in temperature, a preselected amount above the cut-off temperature, compressor operation will resume. Shaft 128 operators impeller 126 and condenser fan 162 continuously. A power cord is shown at 174, for connection of the refrigeration enclosure to a conventional electrical outlet.

Figure 10:
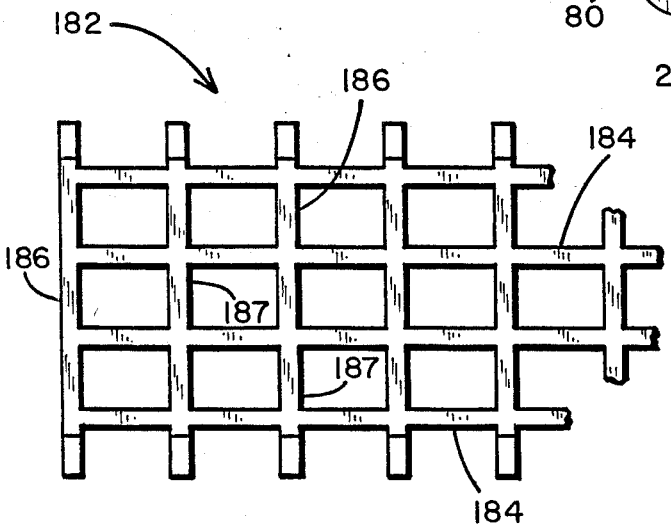
FIG. 10 is a sectional elevation illustrating a grid utilized in an alternative embodiment display container.
Figure 11:
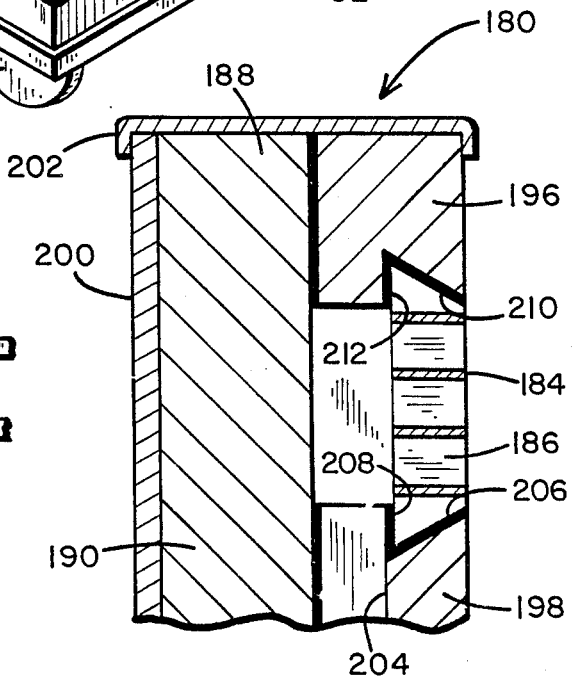
FIG. 11 is a partial sectional view of a side wall of the container.

FIGS. 10 and 11 illustrate part of an alternative embodiment display assembly 180 in which slots 34 along the container side walls are replaced by a rigid plastic grid 182. The grid is rectangular and includes four horizontal ribs 184 and a plurality of intersecting and spaced apart vertical ribs 186. The horizontal ribs are rectangular, while each of the vertical ribs is trapezoidal. Together, ribs 184 and 186 form a series of rectangular windows 187 for passage of air or other fluid.

FIG. 11 depicts a portion of a container side wall 188 including an outside panel 190 similar to the first embodiment outside panels, and an inside panel having upper and lower sections 196 and 198. A housing wall 200 abuts the outside panel, with trim 202 covering the top edges of the side walls. Lower section 198 of the inside panel is provided with a series of upright grooves to form vertical channels 204, substantially similar to the previously-described channels 98. In practice, the container of display assembly 180 can be constructed by first fastening lower section 198 to outside panel 190, inserting grid 182 into a channel formed by an inclined edge 206 and an upright edge 208 in the lower section, then by fastening upper section 196 into place. An inclined edge 210 and backing edge 212 of the top section cooperate with edges 206 and 208 to maintain the grid in place. This procedure is then repeated for the remaining three side walls.

Use of grid 182 eliminates the need to form multiple slots 34, thus simplifying the construction of the display assembly. Moreover, given the structure of materials used in the insulative panels (e.g. Styrofoam ® and the like), the use of the more durable grid enhances strength by reducing the number of cuts made in such material, and enhances the appearance of the display cabinet. While ribs 184 are horizontally disposed in FIG. 11, the ribs if desired can be formed downwardly inclined to the right, to achieve the air flow advantages discussed above in connection with slots 34.

Thus, in accordance with the present invention a display container with multiple built-in upright channels in its side walls, and multiple mutually perpendicular channels in its floor, is conveniently removably connectable to a refrigeration enclosure that draws air from the display container, cools the air, then returns it to the container. The channels provide an air exit path and an air return path, each over approximately half of the display container perimeter as defined by the container side walls. This ensures passage of cooling air over the entire display container volume for a more rapid and even cooling of products in the container. The display assembly is prepared simply by placing the refrigeration enclosure on the base of the housing, then lowering the display container into the housing until it comes to rest upon the refrigeration enclosure. Due to the symmetry of the interfacing openings of the display container and refrigeration enclosure, the display container can be placed upon the enclosure in a reversible configuration without affecting the flow of cooling air.

The passages for air are established by the aligning of the respective container and enclosure openings. As such alignment is the only critical feature in determining air paths, a variety of display containers of different sizes and shapes, and corresponding housings, may be employed in connection with a single refrigeration enclosure. Given this versatility, the utility of the assembly is substantially enhanced at relatively little increased cost.

What is claimed is:

1. A portable refrigeration apparatus including:

a refrigeration enclosure having an upper deck, lower deck, and an upright enclosure side wall means joined to said upper and lower decks; an inlet opening formed in said upper deck for admitting a fluid into said enclosure, and an outlet opening in said upper deck for discharging said fluid out of the enclosure; and a cooling means within said enclosure for cooling said fluid;

a display container including a container floor and an upright container side wall means joined to said floor; first and second openings formed in said floor spaced apart from one another and open to the exterior of said container; a first fluid passageway in said container side wall means in fluid communication with said first opening and with the interior of said container, and a second fluid passageway in said container side wall means in fluid communication with said second opening and with the interior of the container; and a means forming a removable connection of said container and said enclosure, wherein said floor is contiguous with said enclosure upper deck, and said first and second openings are in fluid communication with said inlet and outlet openings, respectively.

2. The apparatus of claim 1 wherein:

said first opening substantially conforms to the size and shape of said inlet opening, and said second opening substantially conforms to the size and shape of said outlet opening.

3. The apparatus of claim 2 wherein:

said first and second openings, and said inlet and outlet openings, are substantially the same size and positioned to allow an alternative connection of said enclosure and container wherein said first opening is in fluid communication with said outlet opening, and said second opening is in fluid communication with said inlet opening.

4. The apparatus of claim 1 wherein:

said first fluid passageway includes a plurality of first upright conduits in said container side wall means, and a first channel means in said container floor between said first upright conduits and said first opening; and said second fluid passageway includes a plurality of second upright conduits in said container side wall means, and a second channel means in said container floor between said second upright conduits and said second opening, said second channel means being in fluid isolation from said first channel means.

5. The apparatus of claim 4 wherein:

said container side wall means is rectangular and includes four substantially planar container side walls, each of said container side walls comprising a pair of associated panels fixed to one another along contiguous surfaces thereof, including an outside upright panel and an inside upright panel, said first and second upright conduits of each said side wall comprising, respectively, elongate first and second upright grooves formed in one of said associated panels, one of said contiguous surfaces cooperating with said upright grooves to define said conduits.

6. The apparatus of claim 5 wherein:

said first and second grooves are formed in said inside upright panels.

7. The apparatus of claim 6 wherein:

each of said first and second conduits is generally triangular in cross section.

8. The apparatus of claim 6 wherein:

said first and second fluid passageways further comprise a plurality of slots near the tops of said inside panels, in fluid communication with said upright first and second conduits.

9. The apparatus of claim 8 wherein:

said slots are inclined downwardly and inwardly of said container.

10. The apparatus of claim 5 wherein:

said first channel means includes first and second pluralities of fluid channels, and said second channel means comprises third and fourth fluid channels in fluid isolation from said first and second fluid channels.

11. The apparatus of claim 10 wherein:

said container floor is substantially planar and horizontal and includes a lower panel and an upper panel fixed to one another along contiguous surfaces thereof, and said first, second, third and fourth fluid channels each comprising, respectively, first, second, third and fourth horizontal grooves formed in one of said upper and lower panels, one of said contiguous surfaces cooperating with said horizontal grooves to define said channels.

12. The apparatus of claim 11 wherein:

said first and second horizontal grooves are perpendicular to one another, and said third and fourth horizontal grooves are perpendicular to one another.

13. The apparatus of claim 6 further including:

a horizontal slot in each of said inside panels open to the interior of said container and said upright conduits, each slot having upper and lower inclined wall portions whereby each said slot converges toward the container interior, and a grid means associated with each slot and defining a plurality of rectangular openings and having inclined edges corresponding to said inclined wall portions of its associated slot whereby said grid is retained within said slot.

14. The apparatus of claim 4 further including:

a housing having a housing base and a housing side wall means mounted to and extended upwardly from said base, said base supporting said enclosure and said housing side wall means surrounding and substantially contiguous with said container side wall means when said container and enclosure are connected.

15. The apparatus of claim 14 further including:

a top cover means overlying and contiguous with top surfaces of said container side wall means and said housing side wall means.

16. The apparatus of claim 15 further including:

a plurality of castors mounted to said base for movably supporting said housing, said enclosure and said container.

17. The apparatus of claim 1 wherein:

said means forming a removable connection comprise first and second flange means extended upwardly from said upper deck and disposed for nesting engagement within said first and second openings, respectively.

18. The apparatus of claim 14 further including:

a flange means extended horizontally outwardly of said enclosure side wall means, and an opening formed through said base corresponding to the shape of said enclosure, whereby said enclosure is supported on said base by said flanges with at least a portion of said refrigeration enclosure disposed below said base and outside of said housing; and an enclosure inlet in said side wall means below said base, and an enclosure outlet through said enclosure side wall means below said base, for passage of air respectively into and out of said enclosure.

* * * * *